US006055949A

United States Patent [19]

Nakamura et al.

[11] Patent Number: 6,055,949

[45] Date of Patent: May 2, 2000

[54] VARIABLE VALVE ACTUATOR APPARATUS

[75] Inventors: Makoto Nakamura; Seinosuke Hara; Yoshihiko Yamada; Keisuke Takeda; Shinichi Takemura, all of Kanagawa, Japan

[73] Assignees: Nissan Motor Co., Ltd., Yokohama; Unisia Jecs Corporation, Atsugi, both of Japan

[21] Appl. No.: 09/219,774

[22] Filed: Dec. 23, 1998

[30] Foreign Application Priority Data

| | | | |
|---|---|---|---|
| Dec. 26, 1997 | [JP] | Japan | 9-358662 |
| Mar. 23, 1998 | [JP] | Japan | 10-073642 |

[51] Int. Cl.[7] ..... F01L 13/00

[52] U.S. Cl. ..... 123/90.16; 123/90.17; 123/90.6

[58] Field of Search ..... 123/90.15, 90.16, 123/90.17, 90.22, 90.39, 90.6; 74/568 R, 567

[56] References Cited

U.S. PATENT DOCUMENTS

| | | | |
|---|---|---|---|
| 5,606,942 | 3/1997 | Tsuzuku et al. | 123/90.16 |
| 5,860,399 | 1/1999 | Speil et al. | 123/90.57 |
| 5,899,180 | 5/1999 | Fischer | 123/90.16 |
| 5,924,334 | 7/1999 | Hara et al. | 74/568 R |
| 5,937,809 | 8/1999 | Pierik et al. | 123/90.16 |
| 5,988,125 | 11/1999 | Hara et al. | 123/90.16 |
| 5,996,540 | 12/1999 | Hara | 123/90.16 |

*Primary Examiner*—Weilun Lo
*Attorney, Agent, or Firm*—Foley & Lardner

[57] ABSTRACT

A variable valve actuation (VVA) apparatus for an internal combustion engine comprises a drive cam fixed to a drive shaft, a valve operating (VO) cam supported by the drive shaft for pivotal motion, and a motion transmitting mechanism interconnecting the drive cam and the VO cam. The VO cam having a cam surface that extends at least from a cam lift start point to a maximum cam lift point. The cam surface includes a first section providing a ramp section, a second section providing a positive acceleration section, and a third section providing a zero acceleration section that includes a situation where acceleration continuously vary within a predetermined infinitesimal window about zero.

7 Claims, 20 Drawing Sheets

VARIABLE VALVE ACTUATOR APPARATUS

FIELD OF THE INVENTION

The present invention relates to variable valve actuator (VVA) apparatuses for internal combustion engines, and more particularly to a VVA apparatus including a valve operating (VO) cam that pivots to move the engine cylinder valve.

BACKGROUND OF THE INVENTION

U.S. Pat. No. 4,397,270 (=JP-A 55-137305) discloses a VVA apparatus. FIG. 26 illustrates this known VVA apparatus. It includes a drive shaft 2, a control shaft 3 with axially spaced eccentric control cams 4, and a pivot structure 9. The pivot structure 9 supports valve operating (VO) cams 8 for pivotal motion above valve lifters 7 of cylinder valves 6 of an internal combustion engine 1. Each VO cam 8 has a cam surface in sliding contact with the associated valve lifter 7 at a top or upper surface 7*a* thereof. Springs 10 are mounted for the VO cams 8, respectively. Each of the springs 10 biases one of the corresponding rocker cams 5 toward its rest position where the associated cylinder valve closes. Rocker arms 5 operate the VO cams, respectively. The eccentric control cams 4, which are in rotary unison with the control shaft 3, bear the rocker arms 5, respectively. An axis of each of the eccentric control cams 4 serves as the center of pivot of the corresponding one of the rocker arms 5. Drive cams 2*a* fixed to the drive shaft 2 operate the rocker arms 5, respectively. An electronic controller is provided. At one end portion 5*a*, each of the rocker arms 5 is in abutting contact with the associated drive cam 2*a*. At the other end portion 5*b*, the rocker arm 5 is abutting contact with a shoulder 8*b* of the associated VO cam 8. Sensors on the engine send information on engine speed, engine load, vehicle speed, and coolant temperature to the controller. At a predetermined switchover point, the controller sends a signal to an actuator for the control shaft 3. As the actuator turns the control shaft 3, the eccentricity of each of the eccentric cams 4 with respect to an axis of the control shaft 3 changes. This alters the position of pivot center of the rocker arms 5 relative to the position of pivot center of the VO cams 8. This causes variation in valve timing and lift of each of the cylinder valves 6.

FIG. 27 illustrates a conventional rotary VO cam 51 that rotates through 360 degrees to move the associated cylinder valve via a valve lifter 61. The valve lifter 61 has an upper surface 61*a* in sliding contact with a cam face of the VO cam 51. FIG. 28 illustrate characteristics presented by the rotary VO cam 51 of FIG. 27. FIG. 28 shows a buffer speed section (or a ramp speed section) θr, a positive acceleration section $\theta_1$ and a negative acceleration section $\theta_2$. During this negative acceleration section $\theta_2$, valve lift deceleration takes place to provide smooth variation in the neighborhood of the maximum lift. The two-dot chain line denotes a speed y' of lift with respect to cam angle. The speed y' become the maximum $y'_{max}$ at the boundary between the positive acceleration section $\theta_1$ and the negative acceleration section $\theta_2$.

Range of distance by which the rotary VO cam 51 slides on the flat upper surface 61 of the valve lifter 61 is called a travel distance t. This travel distance t can be expressed as $$t=dy/d\,\theta.$$

Thus, the travel distance t is equal to the speed y.

Let us now evaluate on the pivotal VO cam 8 of the prior art VVA apparatus illustrated in FIG. 26. In the case of the pivotal cam 8, a sufficiently large valve lift must be produced within a relatively small angle through which the VO cam 8 can pivot. This inevitably requires an increased $y'_{max}$. This increased $y'_{max}$ requires increased travel distance t. Thus, there is the potential risk that the cam nose of the VO cam 8 might come into abutting engagement with the outer edge 7*a* after having disengaged from the flat upper surface 7*a* of the valve lifter 7.

Thus, it is demanded to arrange the bearing structure 9 of the VO cam 8 at a location sufficiently deviated from the centerline of cylinder valve and/or increase the diameter of the upper surface 7*a* of the valve lifter 7. The known VVA apparatus as illustrated in FIG. 28 therefore has restrictions in layout of its component parts. Furthermore, the known VVA apparatus is bulky and difficult to reduce total weight. If the speed y' is reduced to decrease the travel distance t, the maximum lift $y_{max}$ becomes below a satisfactory level.

An object of the present invention is to provide a VVA apparatus wherein both the travel distance t and the maximum lift $y_{max}$ are tamed to provide improved performance without any modification in interconnection among major components parts.

SUMMARY OF THE INVENTION

According to one aspect of the present invention, there is provided a variable valve actuator (VVA) apparatus for an internal combustion engine having an output shaft and a cylinder valve, comprising:

a drive shaft adapted to be driven by the output shaft of the engine for rotation about a drive shaft axis;

a drive cam fixed to said drive shaft for rotation therewith;

a valve operating cam arranged to pivot about a pivot axis;

a cam follower cooperating with said valve operating cam to move the cylinder valve;

a motion transmitting mechanism converting motion of said drive cam about said drive shaft axis into pivotal motion of said valve operating cam, said valve operating cam having a cam surface that extends at least from a cam lift start point to a maximum cam lift point, said cam surface including a first section providing a ramp section, a second section providing a positive acceleration section, and a third section providing a zero acceleration section that includes a situation where acceleration continuously varies within a predetermined infinitesimal window about zero acceleration, said first section extending from said cam lift start point, said second section connecting continuously and smoothly to said first section and extending therefrom toward said maximum cam lift point, said third section connecting continuously and smoothly to said second section and extending therefrom continuously over a predetermined range.

DESCRIPTION OF THE PREFERRED EMBODIMENTS

Figure 1:
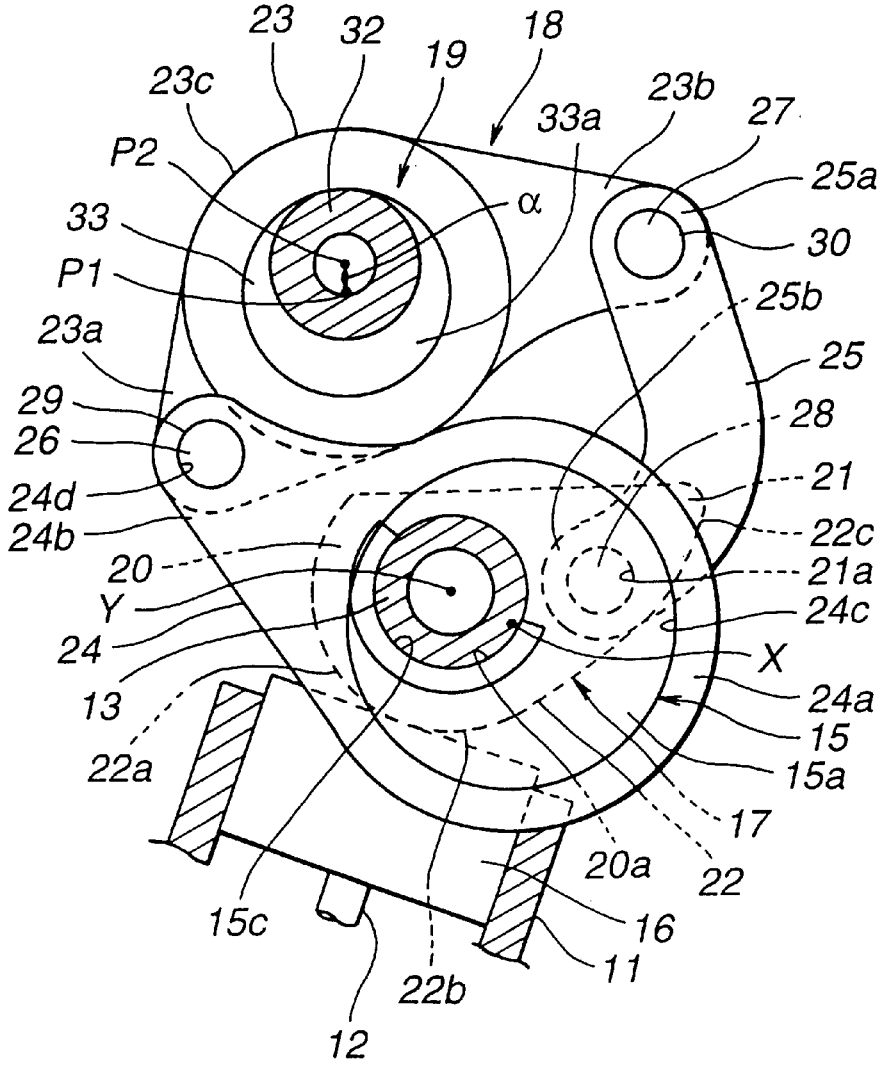
FIG. 1 is a cross section taken through the line 1—1 in FIG. 2, illustrating a first embodiment of a VVA apparatus according to the present invention.
Figure 2:
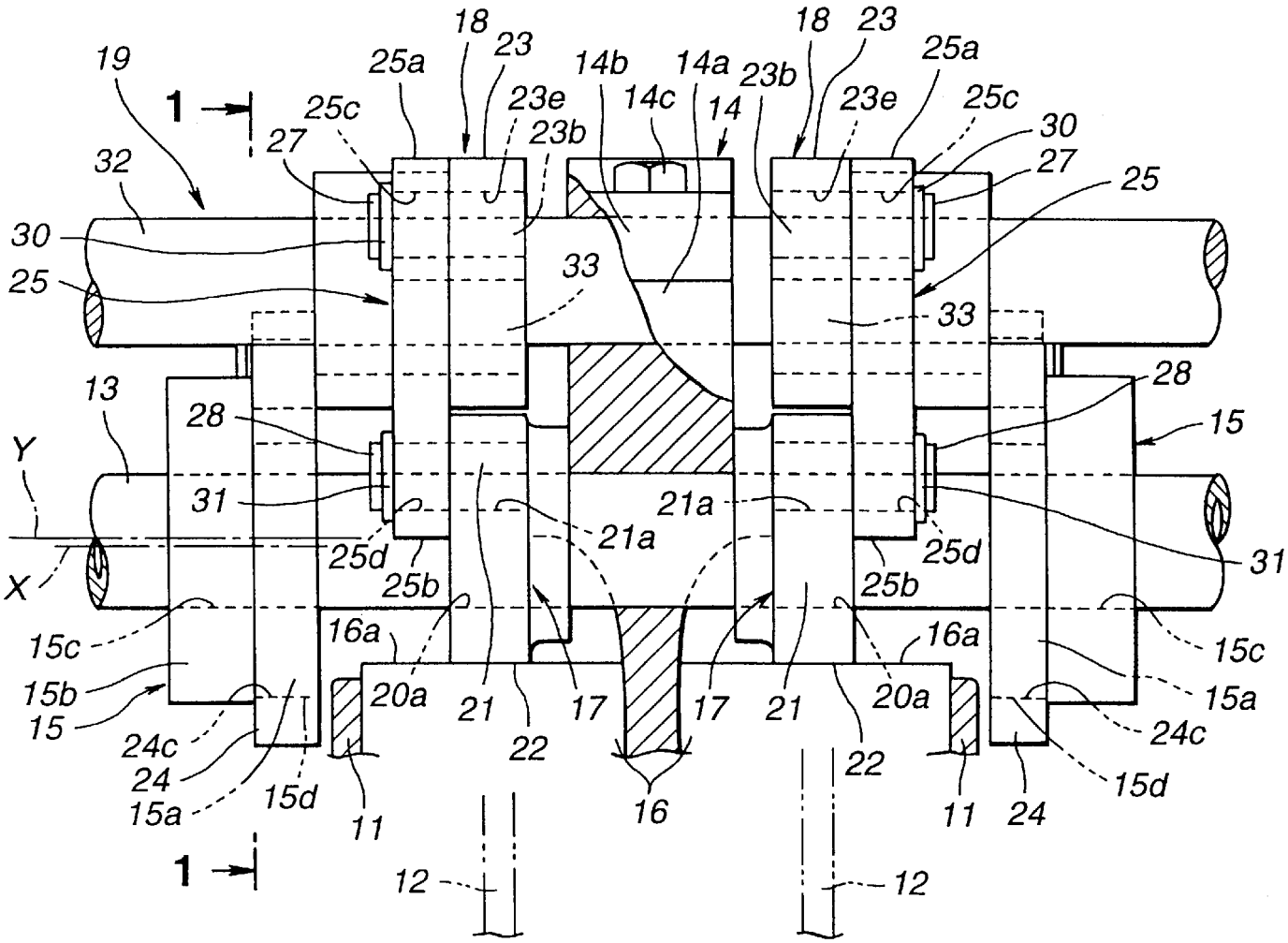
FIG. 2 is a side view of the VVA apparatus partly broken away.
Figure 3:
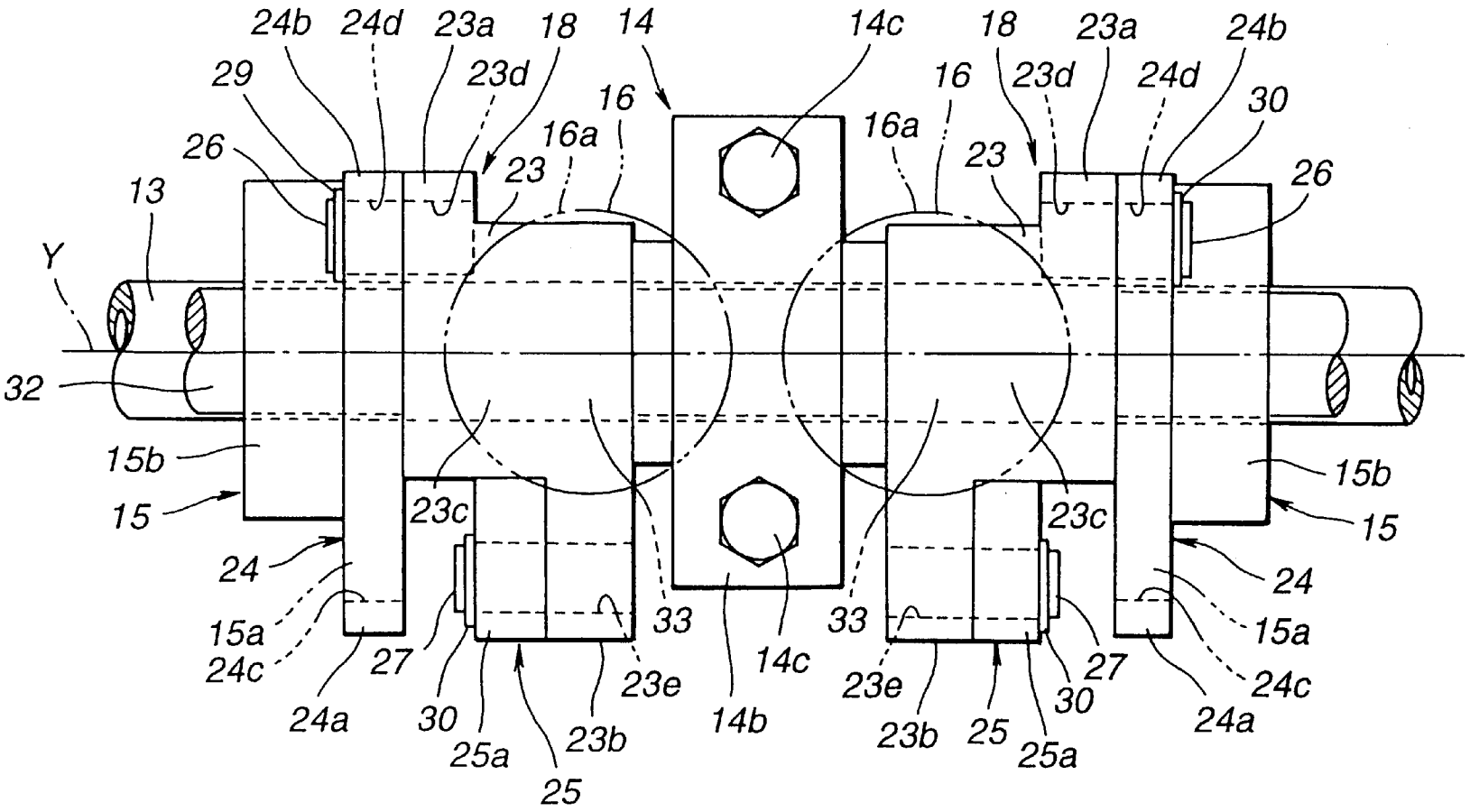
FIG. 3 is a top plan view of the VVA apparatus.

Referring to FIGS. 1 to 25 of the accompanying drawings, the present invention is further described. FIGS. 1 to 3 illustrate a first preferred implementation of the present invention in which a VVA apparatus is mounted for operating cylinder valves, in the form of intake valves in this example, of an internal combustion engine. The engine is equipped with two intake valves for each cylinder.

The engine has a cylinder head 11. The cylinder head 11 supports cylinder valves, in the form of intake valves 12, via valve guides, not illustrated. Valve springs, not illustrated, bias the intake valves 12 toward their rest or closed positions, respectively.

The VVA apparatus includes a drive shaft 13, preferably hollowed. Bearings 14 on the cylinder head 11 support the drive shaft 13 for rotation about a drive shaft axis Y. Drive cams, preferably in the form of eccentric rotary cams 15, are fixed, such as by press fit, to the drive shaft for rotation therewith. As best seen in FIG. 2, two such drive cams 15 are provided for two intake valves 12 for each cylinder. Cam followers, in the form of valve lifters 16 are received in bores of the cylinder head 11 in driving contact with the associated intake valves 12, respectively. In this embodiment, each valve lifter 16 has an upper cam follower surface 16*a* that is flat. Valve operating (VO) cams 17 cooperate with the valve guides 16 for moving or lifting the associated intake valves 12 away from their closed positions against the valve springs. The drive shaft 13 supports the VO cams 17 for allowing pivotal motion of each VO cam 17 about the drive shaft axis Y.

The VVA apparatus also includes a motion transmitting mechanism generally designated at 18 and a position controlling mechanism generally designated at 19. The motion transmitting mechanism 18 interconnects one of the drive cams 15 and the associated VO cam 17 with the drive cam 15 to convert eccentric rotation of the drive cam 15 to pivotal motion of the VO cam 17. The motion transmitting mechanism 18 is variable in position along a transverse plane with respect to the drive shaft axis Y although it is immobile along the drive shaft axis Y. The position controlling mechanism 19 regulates the position of the motion transmitting mechanism 18.

The drive shaft 13 extends along a fore and aft direction of the engine. At one end, the drive shaft 13 carries a follower sprocket, not shown. A timing chain interconnects the follower sprocket and a crankshaft of the engine. In operation of the engine, rotation of the crankshaft is transmitted to the drive shaft 13 in one rotational direction, preferably counterclockwise direction as viewed in FIG. 1.

Each bearing 14 includes a main bracket 14*a* fixed to the upper side of the cylinder head 11 and a sub-bracket 14*b* fixedly held on the main bracket 14*a* by a pair of bolts 14*c*.

The drive cams 15 of each pair are generally annular and include cam sections 15*a* and integral sleeve sections 15*b* extending from outer ends of the associated cam sections 15*a*. A through bore 15*c* extends through each drive cam 15 to permit passage of the drive shaft 15. Each cam section 15*a* is a circular cam having an axis X that is offset from the drive shaft axis Y in a radial direction by a predetermined amount. The drive cams 15 of each pair are fixed to the drive shaft 13 by press fitting at locations on outer remote sides of the two valve lifters 16 for one cylinder. In this embodiment, the cam sections 15*a* have the same cam profiles on their outer peripheral surfaces 15*d*.

Figure 4:
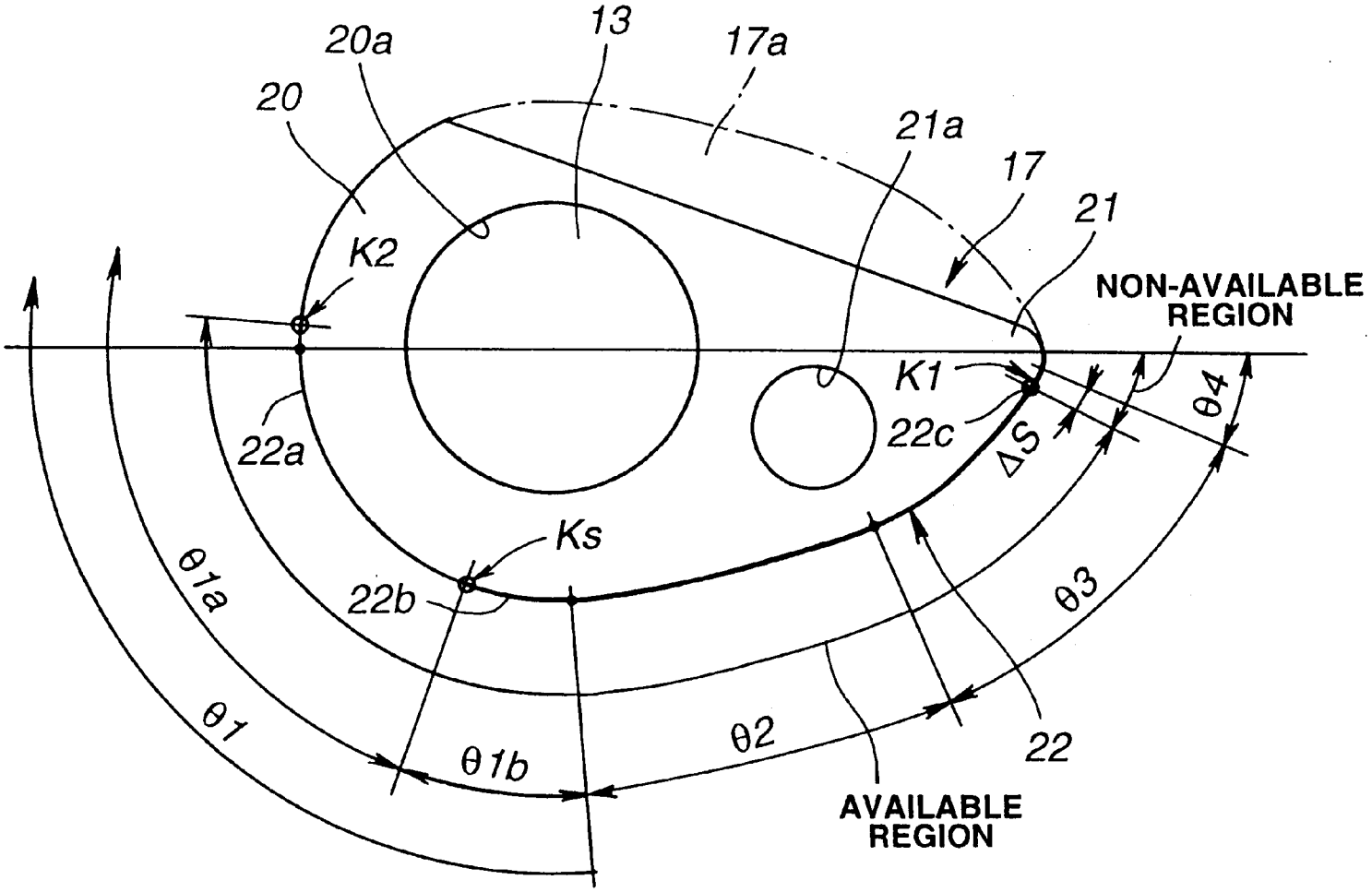
FIG. 4 illustrates a VO cam used in the VVA apparatus.

Referring also to FIG. 4, each VO cam 17 has a base 20 formed with a bore 20*a* through which the drive shaft 13 extends in a manner to allow pivotal motion of the VO cam 17 relative to the drive shaft 13. A cam nose 21 protrudes from the base 20 in a radial direction with respect to the VO cam center on the drive shaft axis Y (see FIG. 1). At a point between the base 20 and the protruded end of the cam nose 21, the VO cam 17 is formed with a pin-receiving hole 21*a*. Viewing in FIG. 4, at its lower periphery, each VO cam 17 has a cam face 22. The cam face 22 includes a base circle face section 22*a* that extends along the periphery of the base 20 and a ramp face section 22*b*, which connects smoothly to the base circle face section 22*a* and extends toward the protruded end of the cam nose 21. The ramp face section 22*b* is elevated gradually from the base circle along which the base circle face section 22*a* extends as the VO cam 17 pivots about the drive shaft axis Y clockwise as viewed in FIG. 4. The ramp face section 22*b* connects smoothly to a cam lift face section. The cam lift face section extends from the ramp face section 22*b* to a summit face section 22*c*, which provides a maximum lift. Pivoting the VO cam 17 brings one of the base circle face section 22*a*, ramp face section 22*b*, cam lift face section and summit face section 22*c* into opposed or contact relation with the upper surface 16*a* of the associated valve lifter 16.

Figure 5:
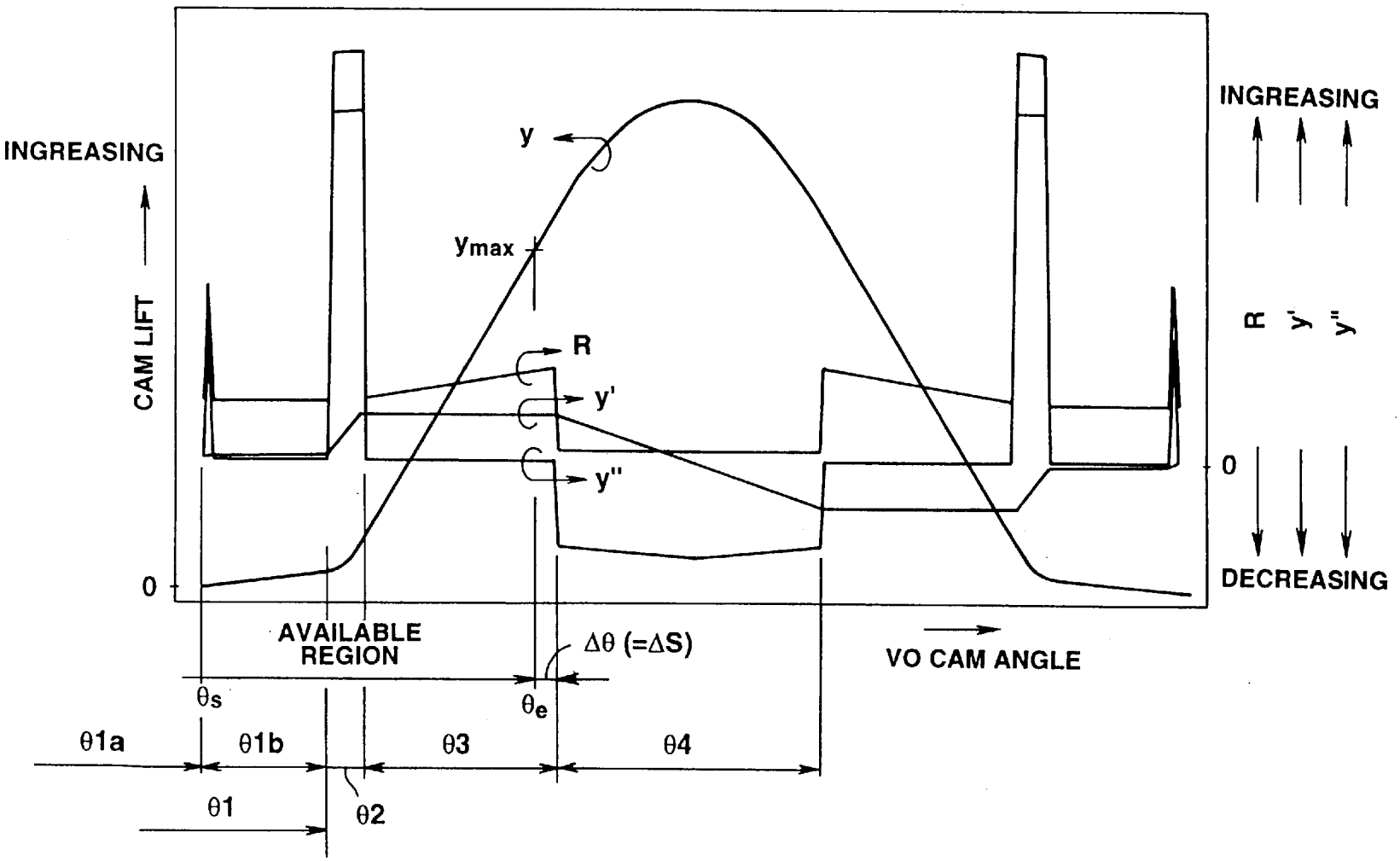
FIG. 5 is a graphical representation of dynamics characteristics of the VO cam of the VVA apparatus.

Referring to FIGS. 4 and 5, acceleration characteristic of the VO cam 17 is explained. In FIG. 4, the reference character K2 denotes a contact starting point, and the reference character K2 denotes a valve lift starting point. The contact starting point K2 is located in the base circle face section 22*a*. A buffer section θ1 extends over the contact starting point K2, valve lift starting point Ks and a portion of the ramp face section 22*a* and thus extend through the same angle as a base circle section θ1*a* and a ramp speed section θ1*b*. A positive-acceleration section θ2 extends over the remaining portion of the ramp face section 22*a* and toward the summit face section 22*c* of the cam nose 21. A zero-acceleration section θ3 extends from the positive-acceleration section θ2 and over a portion of the summit face section 22*c*. A negative acceleration or deceleration section θ4 extends from the zero-acceleration section θ3 toward the protruded end of the cam nose 22 and over the remaining portion of the summit face section 22*c*. It is understood that the acceleration characteristic consists of the buffer, positive-acceleration, zero-acceleration and negative-acceleration sections θ1, θ2, θ3 and θ4.

The zero-acceleration section θ3 includes a maximum lift point K1 located within the summit face section 22*c*. A region that ranges from the contact starting point K2 to the maximum lift point K1 along the cam face 22 is set aside as an available region, which is to be used for cooperation with the upper surface 16*a* of the associated valve lifter 16. A region that ranges from the maximum lift point K1 within the summit face section 22*c* to the end of the negative-acceleration section θ4 is set aside as a non-available region, which is not to be used for cooperation with the upper surface 16*a* of the valve lifter 16.

Referring back to FIGS. 1 to 3, each motion transmitting mechanism 18 includes a rocker arm 23 above the drive shaft 13, viewing in FIGS. 1 and 2, a link or crank arm 24 and a link rod 25. The crank arm 24 interconnects one end portion 23*a* of the rocker arm 23 and the drive cam 15. The link rod 25 interconnects the other end portion 23*b* of the rocker arm 23 and the VO cam 17.

As readily seen from FIG. 3, each rocker arm 23 has two offset arm sections, which extend from a sleeve-like base 23*c* and include the one and other end portions 23*a* and 23*b*, respectively. The sleeve-like base 23*c* surrounds a control cam 33 to be later described so that the rocker arm 23 can rotate relative to the control cam 33. The rocker arm 23 is formed with two pin-receiving holes, namely a first hole 23*d* through the one end portion 23*a*, a second hole 23*e* through the other end portion 23*b*, as shown in FIG. 3. The first hole 23*d* receives a pin 26 that extends through the crank arm 24 in a manner to allow relative rotation. The second hole 23*e* receives a pin 26 that extends through one end portion 25*a* of one of the link rods 25 in a manner to allow relative rotation.

Each crank arm 24 includes an enlarged annular base 24*a* and a protrusion 24*b* extending from a portion of the outer periphery of the annular base 24*a*. The annular base 24*a* is formed with a hole 24*c* receiving a cam section 15*a* of one of the drive cams 15 with a clearance wide enough to allow relative rotation of the crank arm 24 with respect to the associated drive cam 15. The protrusion 24*b* is formed with a pin-receiving hole 24*d* receiving the pin 26. Relative rotation between the protrusion 24*b* and the pin 26 is provided.

As best seen in FIG. 1, each link rod 25 is curved between one and other rounded end portions 25*a* and 25*b*. The one end portion 25*a* is formed with a pin-receiving hole 25*c*, and the other end portion 25*b* is formed with a pin-receiving hole 25*d*. The pin-receiving hole 25*c* receives the pin 27, and the pin-receiving hole 25*d* receives a pin 28 that is fitted into the pin-receiving hole 21*a* of the VO cam 17. Relative rotation of the pin 27 with respect to the link rod 25 is provided. Relative rotation of the pin 28 with respect to the link rod 25 is provided.

Snap rings 29, 30 and 31 are mounted at ends of the pins 26, 27 and 28 to restrain axial displacement of the crank arm 24 and link rod 25 along the drive shaft axis Y.

The position controlling mechanism 19 includes a control shaft 32, and control cams 33, which are fixed to the control shaft 32 and serve as pivot centers of the rocker arms 23, respectively. The control shaft 32 is supported above the drive shaft 13 by the same bearings 14 that support the drive shaft 13. The control shaft 32 has a control shaft axis P2 of rotation.

Each control cam 33 is an eccentric cylindrical cam having a cam axis P1 that is displaced from the control shaft axis P2 by a predetermined amount α (alpha).

The control shaft 32 extends along the drive shaft 13 in parallel relationship. At one end, the control shaft 32 is drivingly connected to an electromagnetic actuator, not shown, for rotation about the control shaft axis P2 through a predetermined range of angles. The electromagnetic actuator is operable in response to a control signal from a controller, not illustrated. The control inputs sensor signals from sensors, such as a crankshaft angle sensor, an airflow meter, a coolant temperature sensor, and generates the control signal after computation on the input sensor signals to determine current engine operating state.

FIGS. 1 and 6–9 illustrate a position which each of the motion transmitting mechanisms 18 will be adjusted to take by the position controlling mechanism 19 during engine operation at high speed with heavy load. In the illustrated position of the motion transmitting mechanisms 18, each control cam 33 has its thickened portion 33*a* oriented toward the associated VO cam 17 to cause the VO cam 17 to pivot between a position illustrated in FIG. 1 and a position illustrated in FIG. 9.

Cam lift characteristic due to pivotal motion of each VO cam 17 under this condition of the motion transmitting mechanisms 18 is explained. In the position as illustrated in FIG. 1, the base circle face section 22*a* of the VO cam 17 is located above the upper surface 16*a* of the valve lifter 16, thus allowing the valve springs to close the associated intake valves 12.

Figure 6:
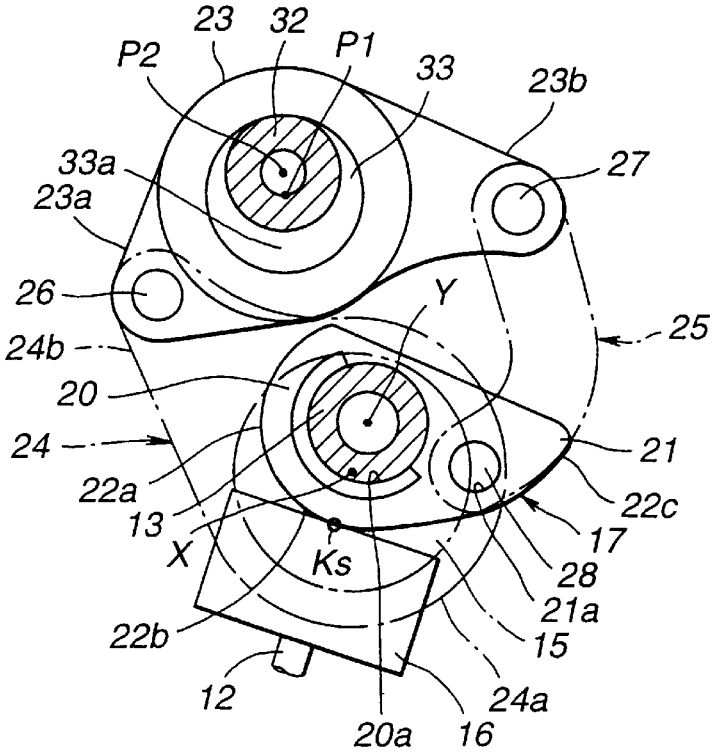
FIGS. 6 to 9 illustrate four different positions of component parts of the VVA apparatus during the highest lift mode suitable for engine operation at high speeds with heavy load.
Figure 7:
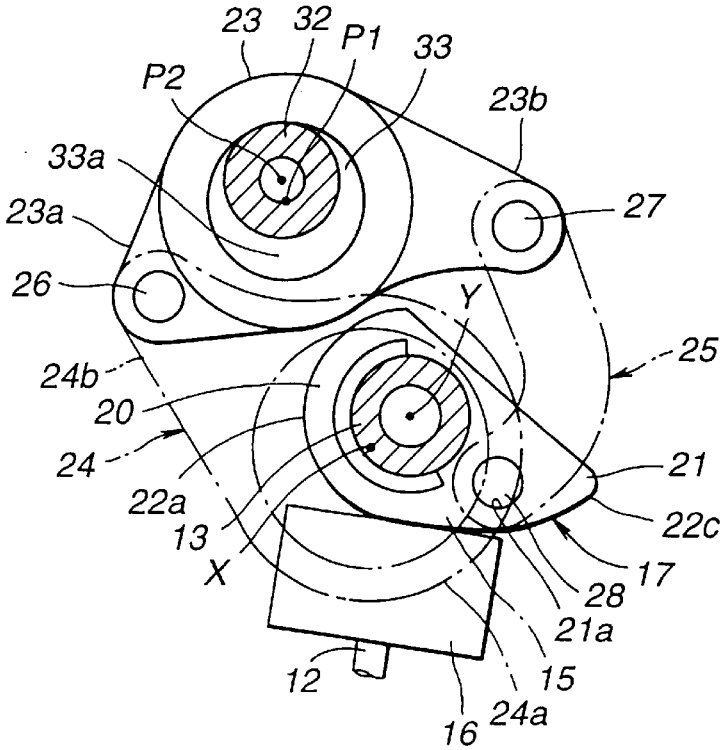

Pivoting the VO cam 17 clockwise from the FIG. 1 position to a position as illustrated in FIG. 6 brings the valve lift starting point Ks of the cam face 22 into contact with the upper surface 16*a* of the valve lifter 16, marking the start of the valve lift. Further clockwise pivotal motion beyond the position of FIG. 6 to a position as illustrated in FIG. 7 causes the VO cam 17 to perform the final portion of the buffer section θ1 (see FIG. 5). Thus, clockwise pivotal motion of the VO cam from the position of FIG. 1 to the position of FIG. 7 corresponds to the buffer section θ1 shown in FIG. 5.

Figure 8:
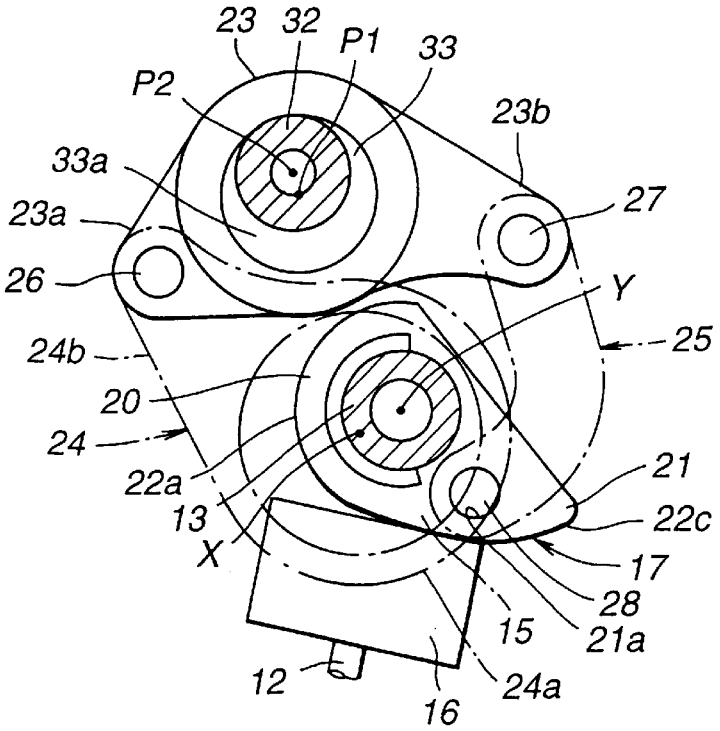

Further clockwise pivotal motion of the VO cam 17 beyond the position of FIG. 7 causes the VO cam 17 to enter the positive-acceleration section θ2. The positive-acceleration section θ2 terminates when the VO cam 17 reaches a position as illustrated in FIG. 8. Further clockwise pivotal motion of the VO cam 17 beyond the position of FIG. 8 causes the VO cam 17 to enter the zero-acceleration section θ3 shown in FIG. 5. Subsequently, when the VO cam 17 has pivoted clockwise to a position as illustrated in FIG. 9, at the maximum lift point K1 within the zero-acceleration section θ3, the summit face section 22*c* comes into contact with the upper surface 16*a* of the valve lifter 16.

Figure 9:
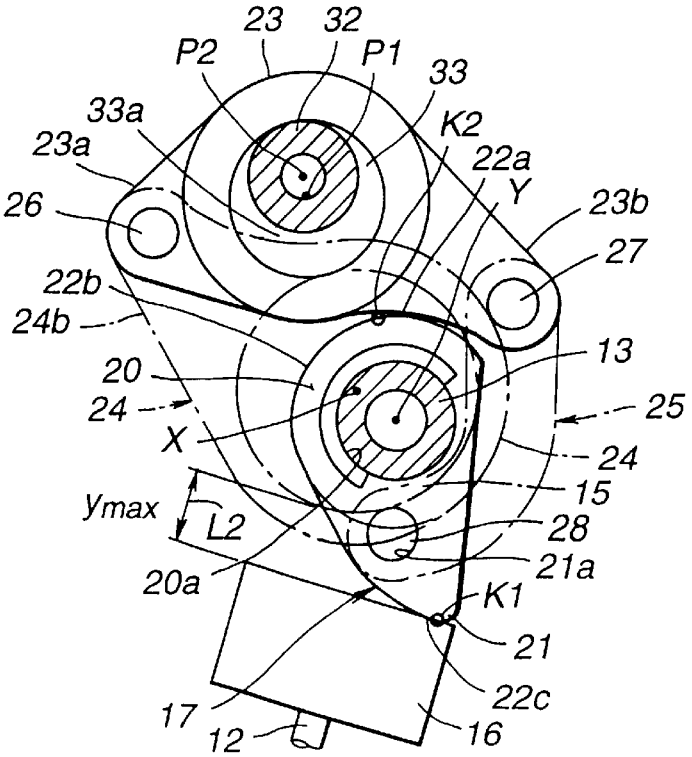

The zero-acceleration section θ3 continues during pivotal motion of the VO cam 17 from the position of FIG. 8 to the position of FIG. 9. During this range of pivotal motion, the cam lift changes at a constant speed or rate y', where y is the VO cam lift and y'=dy/dθ. Because the speed y' is equal to a travel distance t of the VO cam 17 on the upper surface 16*a* and constant, the travel distance t does not alter during this range of pivotal motion, causing a reduction in the maximum $t_{max}$ of the travel distance t.

Acceleration y" of the cam lift y can be expressed as $$y''=dy'/d\theta \qquad \text{Eq. 1.}$$

The acceleration y" is almost zero (y"≈0) and thus y' is constant (y'=constant) during pivotal motion of the VO cam 17 over the zero-acceleration section θ3. As a result, the maximum $t_{max}$ of the travel distance t reduces since the travel distance is constant over the zero-acceleration section θ3.

The cam lift y results from integrating the speed y' with respect to the VO cam angle θ. Thus, the maximum cam lift $y_{max}$ results from integrating y' with respect to the VO cam angle θ over a range from $\theta_s$ to $\theta_e$. $\theta_s$ and $\theta_e$ are angles at which the contact starting point K2 and the maximum lift point K1 contacts with the upper surface 16*a* of the valve lifter 16. Thus, $y_{max}$ can be expressed as follows.

$$y_{\max} = \int_{\theta s}^{\theta e} y' d\theta. \qquad \text{Eq. 2}$$

The speed y' is kept as high as the maximum $y'_{max}$ over the whole zero-acceleration section θ3, causing an appreciable increase in the maximum cam lift $y_{max}$.

From the preceding description, it will now be understood that the zero-acceleration section θ3 provides a reduction in the maximum travel distance $t_{max}$ and an increase in the maximum cam lift $y_{max}$. The reduction in the maximum travel distance $t_{max}$ does not require a valve lifter with wide upper surface area, making it possible to use a valve lifter with reduced upper surface area. The increase in the maximum cam lift $y_{max}$ enhances performance of the engine.

Referring to FIG. 4, the pivotal VO cam 17 does not use the upper periphery of its cam nose 21 that is opposite to the lower periphery where the cam face 22 is formed. Thus, a portion 17*a* extending inwardly from the upper periphery of the cam nose 21 may be removed by grinding, resulting in a reduction in the overall size of the contour as compared to a rotary cam.

The contour of the protruded end of the cam nose 21 may have a curvature with a small radius because this portion is where the negative-acceleration section θ4, which is not used, is formed. The radius of curvature R can be expressed as R=Rb+y+y", where Rb is a radius of curvature of the base circle. The radius R becomes small because the acceleration y" is negative over the negative-acceleration section θ4.

As described before, the maximum lift point K1 is located within the zero-acceleration section θ3. Thus, the valve lifter 16 will not come into contact with the negative-acceleration section θ4 that has a small radius of curvature although it comes into contact with the zero-acceleration section θ3 that has a large radius of curvature. A reduction in bearing stress between the cam face 22 and the upper surface 16*a* of the valve lifter 16 is accomplished, thus suppressing occurrence of wear.

In FIG. 4, the maximum lift point K1 is spaced from the boarder with the negative-acceleration section θ4 by a distance ΔS. In FIG. 5, this distance is expressed in terms of Δθ. The provision of the distance Δθ prevents the negative-acceleration section θ4 of the cam face 22 from contacting with the valve lifter 16 even if clearances between component parts of each motion transmitting mechanism 18 become large after use over extended period of time. Thus, occurrence of wear is suppressed even if such large clearances take place.

Figure 13:
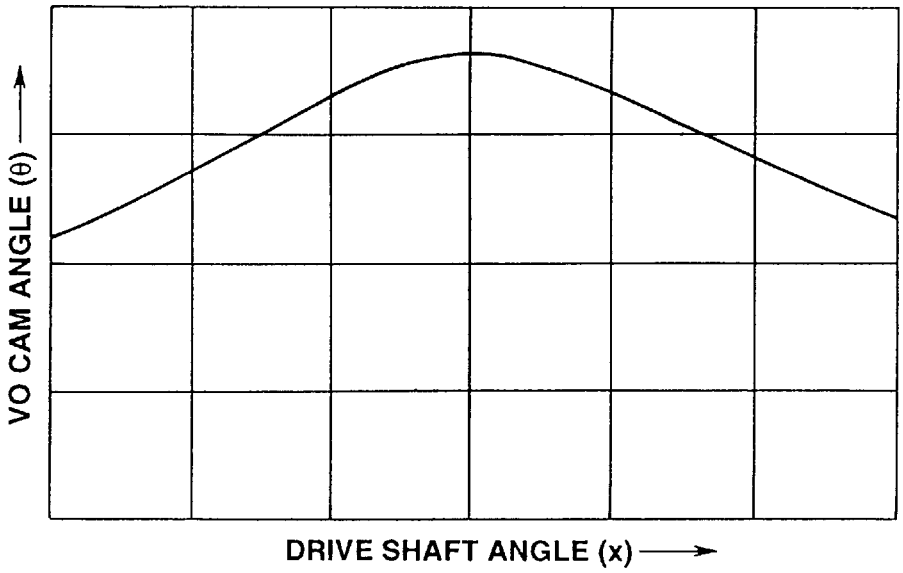
FIG. 13 is a graphical representation of a VO cam angle versus drive shaft angle characteristic presented by the VVA apparatus.
Figure 14:
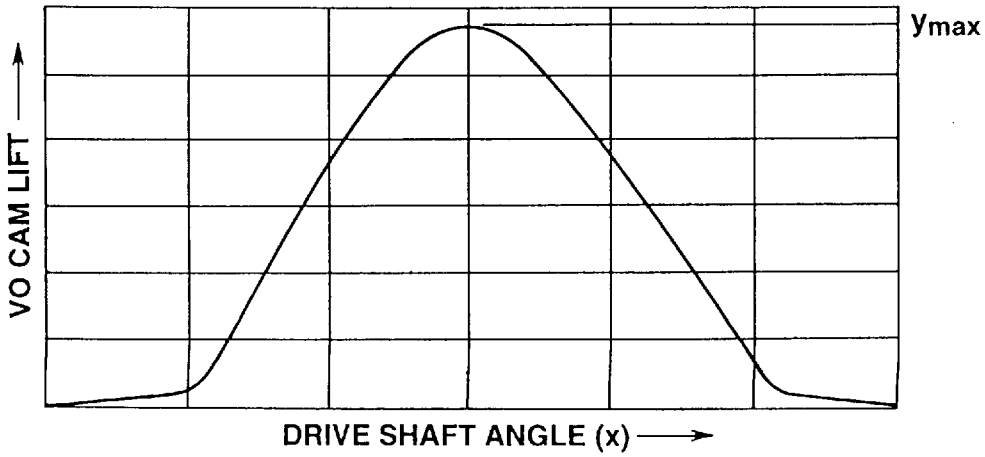
FIG. 14 is a graphical representation of a VO cam lift versus drive shaft angle characteristic presented by the VVA apparatus.

The motion transmitting mechanism 18 interconnects a drive cam 15 fixed to the drive shaft 13 and a VO cam 17 pivoted to the drive shaft 13. The VO cam 17 pivots relative to the drive shaft 13. FIG. 13 illustrates a VO cam angle θ versus drive shaft angle X characteristic curve. According to the curve, the VO cam angle θ gradually changes before and after the maximum to present a smooth curve having a large radius of curvature. FIG. 14 illustrates a VO cam lift y versus drive shaft angle X characteristic curve if the available region of the VO cam 17 (see FIGS. 4 and 5) is used. It will be appreciated that the characteristic curve of FIG. 14 presents a sufficiently smooth cam lift variation.

It will now be appreciated that locating the maximum lift point K1 within the zero-acceleration section θ3 of the pivotal VO cam 17 presents substantially the same smooth cam lift characteristic as is given by locating the maximum lift point within a negative-acceleration section of a rotary VO cam. The former is advantageous over the latter in that bearing stress between the cam face and the upper surface of the valve lifter reduces because the upper surface of the valve lifter continues to contact with the zero-acceleration section that has relatively large radius of curvature.

During engine operation at high speed with heavy load, the VO cam angle 17 pivots between the position of FIG. 1 and the position of FIG. 9. In the illustrated position of FIG. 9, at the maximum lift point K1, the cam face 22 presses the upper surface 16*a* of the valve lifter 16, so that a valve lift L2 of the valve lifter 16 is equal to the maximum cam lift $y_{max}$.

Figure 12:
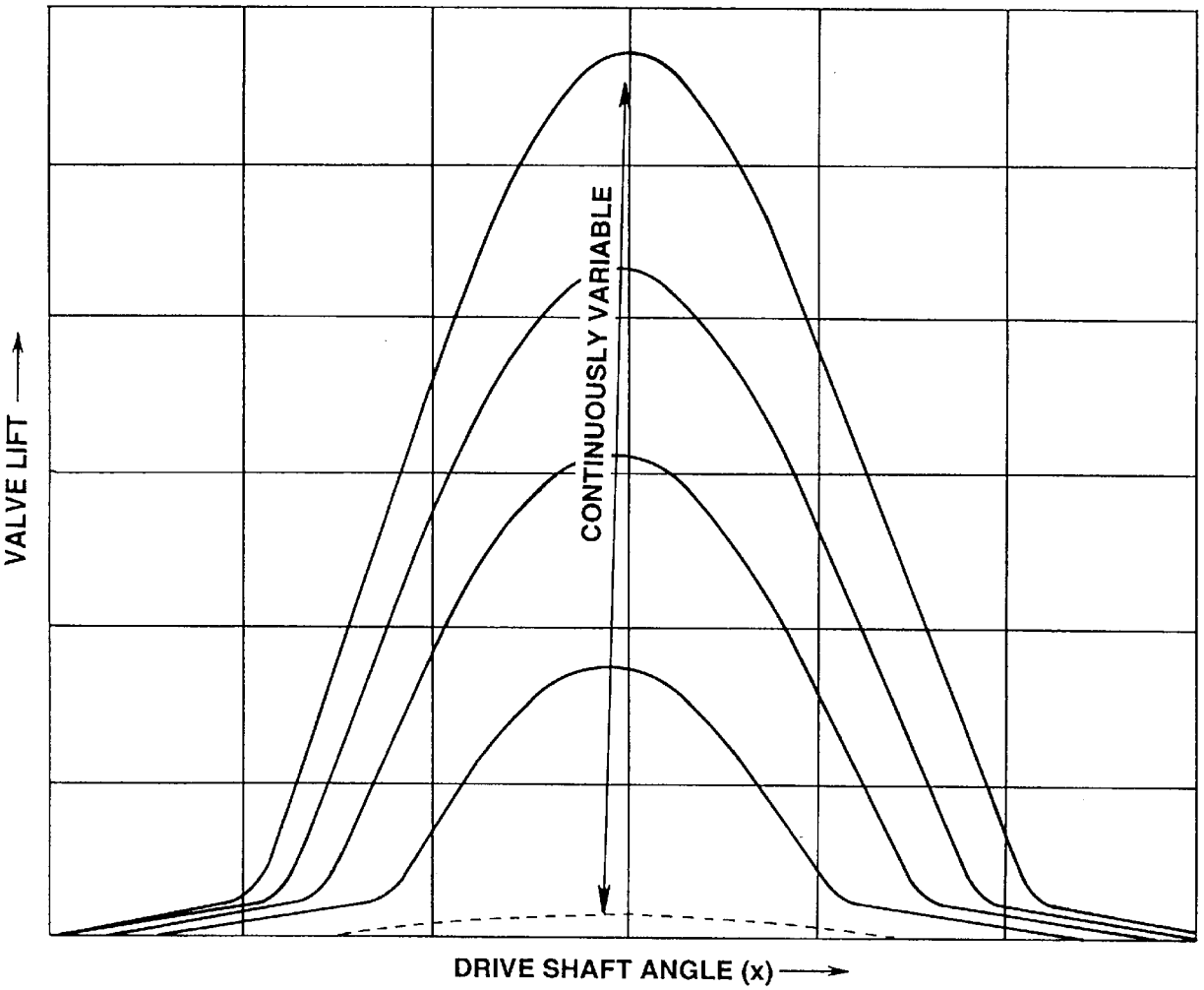
FIG. 12 is a graphical representation of varying valve lift characteristics presented by the VVA apparatus.

Thus, the VVA apparatus presents cam lift characteristic having the highest maximum cam lift during engine operation at high speed with heavy load. FIG. 12 illustrates typical valve lift characteristic curves that can be given by the VVA apparatus. These curves clearly show that valve opening timing advances and valve closing timing retards if valve lift increases. This result in sufficiently large output due to increased intake loading efficiency.

Upon a shift to engine operation at idling, the electromagnetic actuator rotates the control shaft 32 in response to the control signal from the controller. This rotation causes each control cam 33 to rotate from the position of FIG. 1 to a position of FIG. 10, moving the thickened portion 33*a* upwardly viewing in FIGS. 1 and 10, thus moving the axis P1 of the associated control cam 33, i.e., the pivot axis of the rocker arm 23, away from the drive shaft axis Y. This movement of the pivot axis P1 of each rocker arm 23 causes the associated VO cam 17 to shift from the position of FIG. 1 to the position of FIG. 10.

Under this condition, rotation of the drive cams 15 by the drive shaft 13 causes pivotal motion of rocker arms 23 about the pivot axis P1 that has been lifted to the position of FIG.

Figure 10:
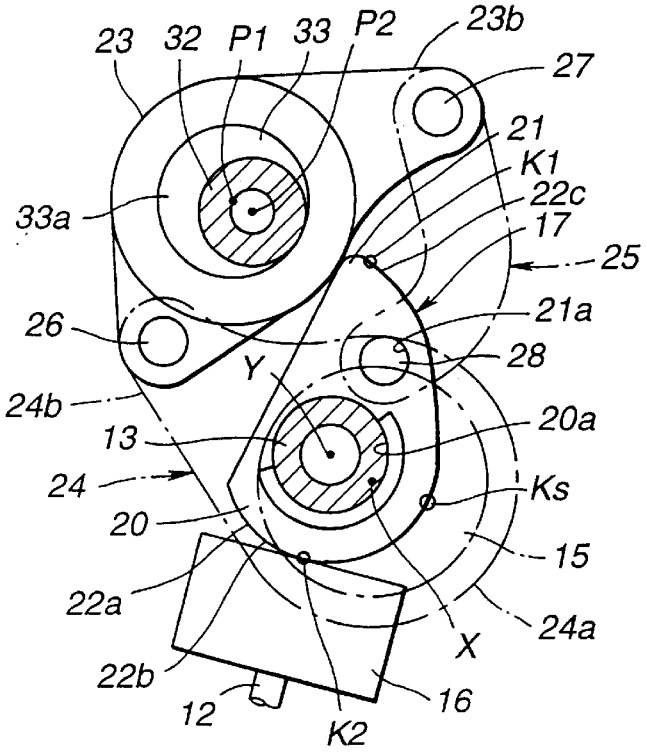
FIGS. 10 and 11 illustrate two different positions of component parts of the VVA apparatus during the lowest lift mode suitable for engine operation at idling.
Figure 11:
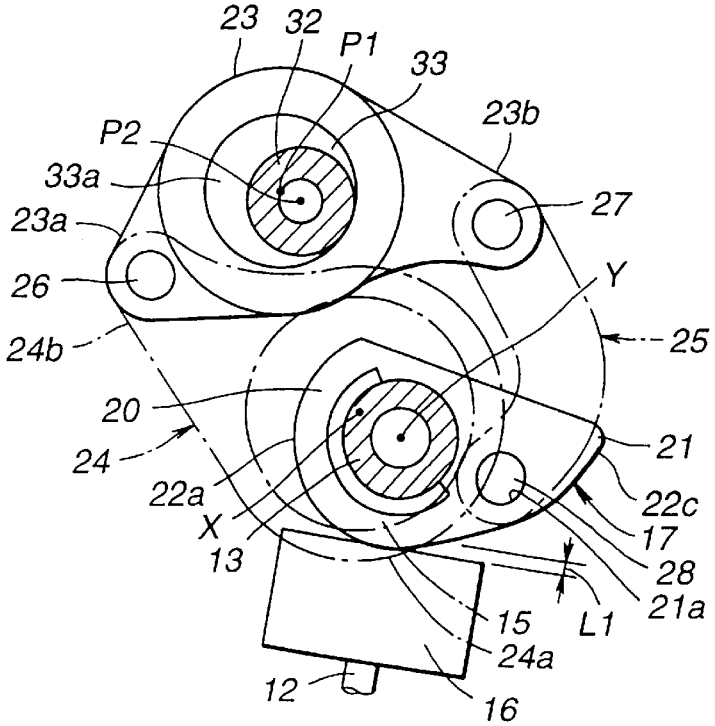

10 from the position of FIG. 1, thus causing the VO cams to pivot between the position of FIG. 10 and the position of FIG. 11. As shown in FIG. 11, the valve lift L1 that is smaller than the valve lift L2 (see FIG. 9) is provided. The valve lift characteristic for engine operation at idling is illustrated by the dotted line in FIG. 12. This results in increased intake flow, improved combustion state, and enhanced fuel economy.

In addition to the previously described two positions, the motion transmitting mechanism 18 can take any intermediate positions continuously by means of the controlling mechanism 19, thus presenting continuously varying valve lift characteristics as shown in FIG. 12.

Figure 15:
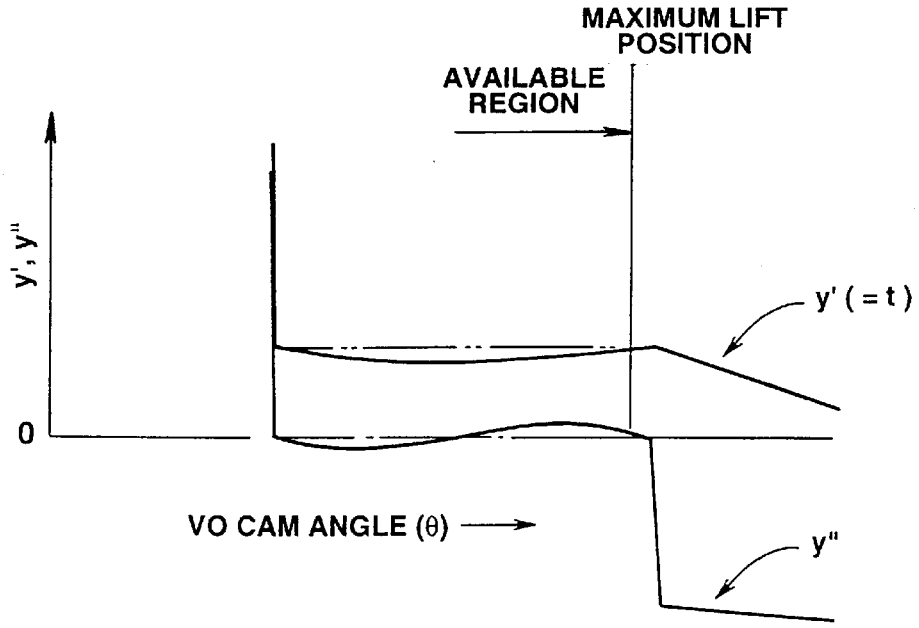
FIG. 15 is a graphical representation of characteristic presented by one configuration of a VO cam wherein acceleration continuously varies across zero like a wave within a predetermined infinitesimal window or range about zero acceleration during a zero acceleration section.

Although the acceleration y" is zero over the zero-acceleration section θ3 in the previously described embodiment, the acceleration y" may continuously vary or deviate from zero within a predetermined infinitesimal range or window about zero over zero-acceleration section as shown in FIG. 15. The deviation from zero is so chosen as to provide a situation where, in operation, local wear of the valve lifter is prevented. Specifically, a pumping effect owing to continuous varying contact point between the VO cam and the valve lifter draws in lubricating oil into a space between the VO cam and the valve lifter. This supply of lubricating oil reduces the possibility that such local wear may occur. In this example, the acceleration y" varies continuously via deviation in negative direction and then deviation in positive direction. The travel distance t (=y') alters during pivotal motion of VO cam over this zero-acceleration section where the acceleration y" is subject to the variation. This prevents local wear of upper surface 16*a* of valve lifter 16.

If desired, the acceleration y" may continuously varies via deviation in positive or negative direction only.

Figure 16:
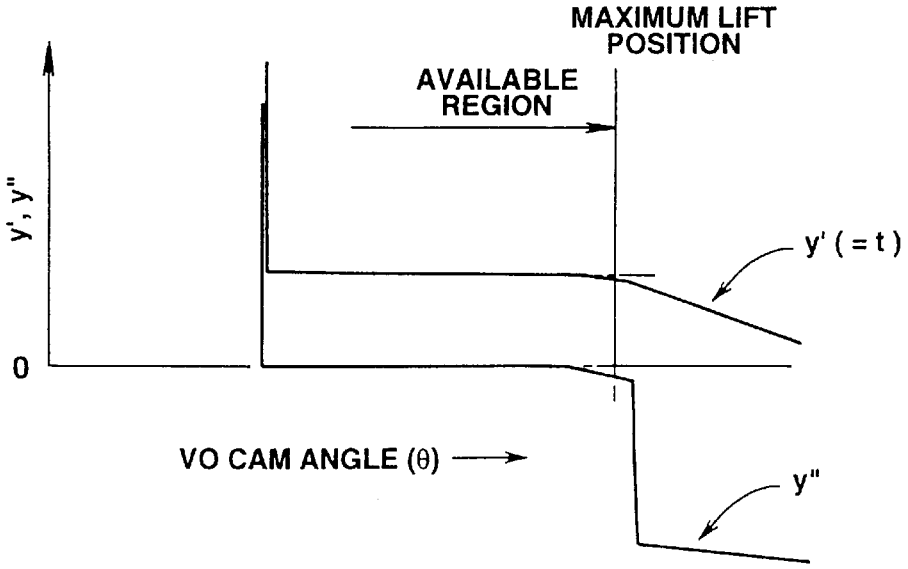
FIG. 16 is a graphical representation of characteristic presented by another configuration of a VO cam wherein acceleration varies from zero in negative direction within the predetermined window in the vicinity of the maximum lift position.

FIG. 16 shows a further modified zero-acceleration section θ3. According to this modification, the acceleration y" varies in the negative direction from zero in the neighborhood of the maximum lift position. In the neighborhood of the maximum lift position, the contact point of valve lifter upper surface 16*a* with cam face 22 moves inwardly of the available region away from the edge of the upper surface 16*a*. Thus, the valve lifter upper surface 16*a* is free from local wear and damage of edge due to abutting contact with the cam face 22.

Figure 17:
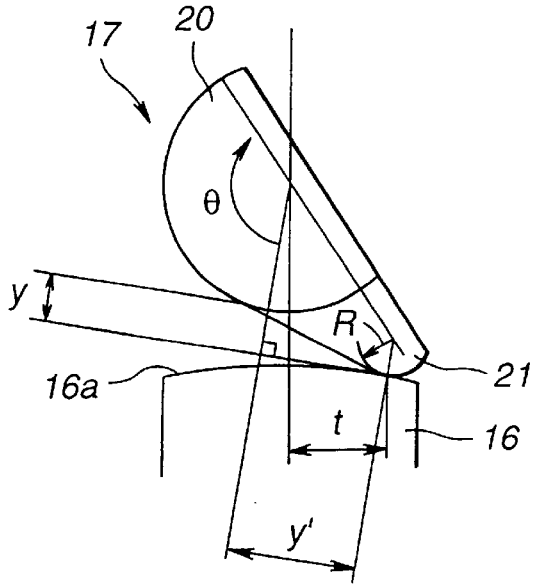
FIG. 17 illustrates amount of travel between a VO cam and a valve lifter with a circular protruded surface.

In the preceding description of the embodiments, the upper surface 16*a* of the cylinder head 16 flat. The valve lifter upper surface 16*a* may be circularly protruded as shown in FIG. 17. In this case, as readily seen from FIG. 6, the travel distance t is less than y' (=dy/dθ). Thus, if the circularly protruded upper surface 16*a* is used, the travel distance t decreases further.

In the preceding embodiments, a valve lifter is explained as a typical example of a cam follower cooperating with a VO cam. The cam follower is not limited to the valve lifter. A rocker arm type cam follower may be used.

Figure 18:
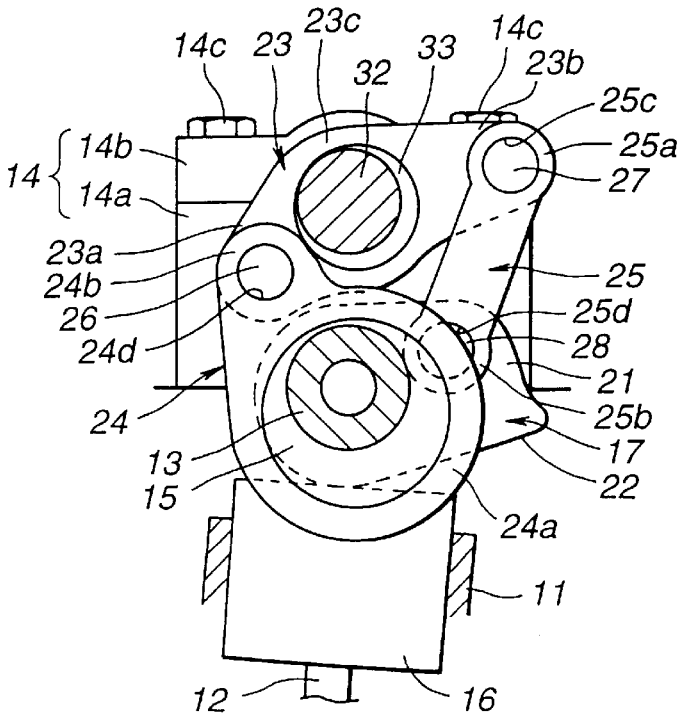
FIG. 18 is a similar view to FIG. 1, illustrating a second embodiment of a VVA apparatus.
Figure 19:
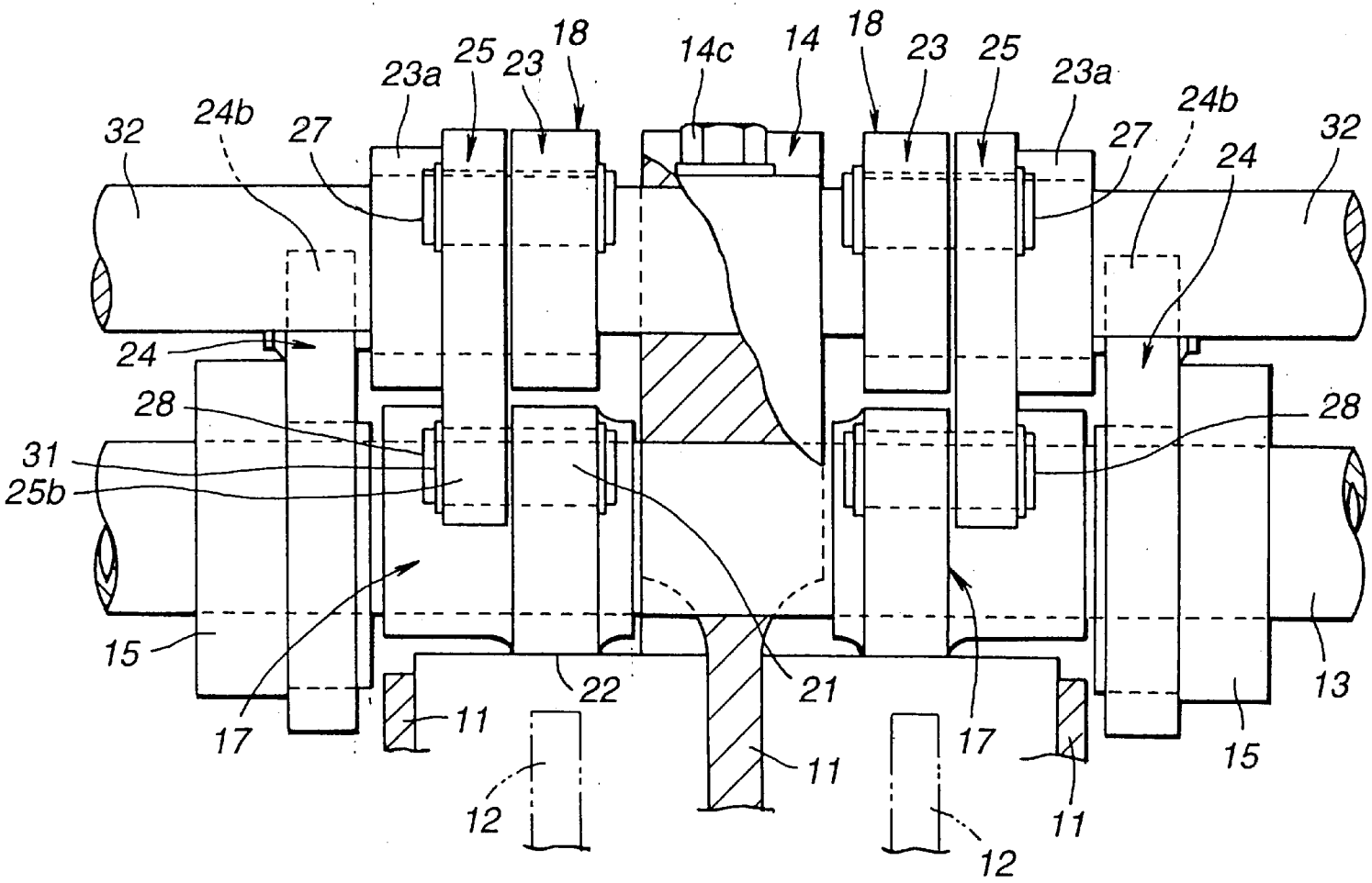
FIG. 19 is a side view of the VVA apparatus of FIG. 18 partly broken away.
Figure 20:
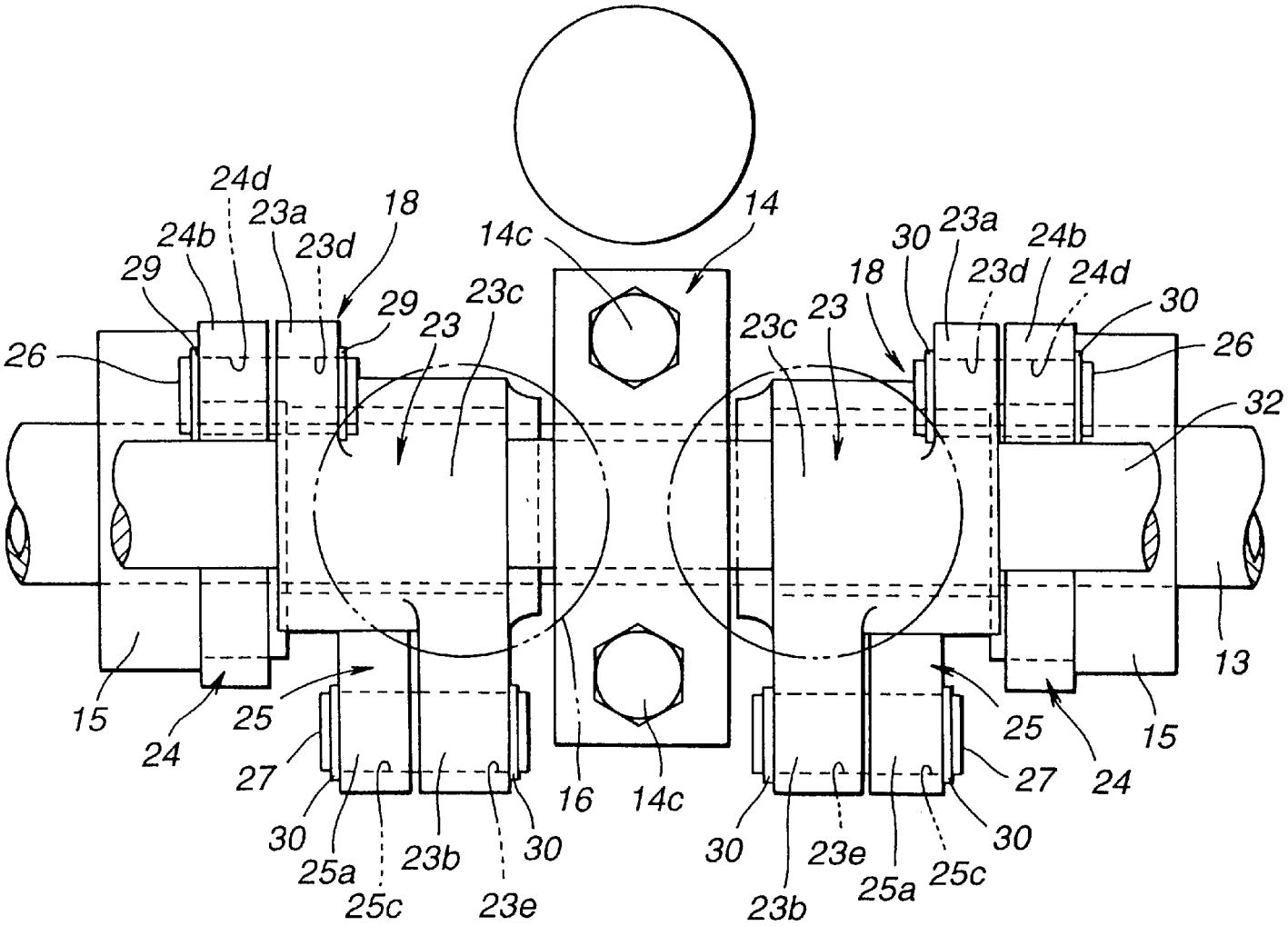
FIG. 20 is a top plan view of the VVA apparatus of FIG. 18.

Referring to FIGS. 18 to 21, other embodiment of a VVA apparatus is explained. A hardware as illustrated in FIGS. 18 to 20 is substantially the same as that illustrated mainly in FIGS. 1 to 3 except a minor difference that a link rod 25 is straight. Another minor difference resides in location of a control shaft 32. According to this embodiment, the control shaft 32 is located above a drive shaft 13 that is located above valve lifters 16 of cylinder valves in the form of intake valves 12.

Figure 21:
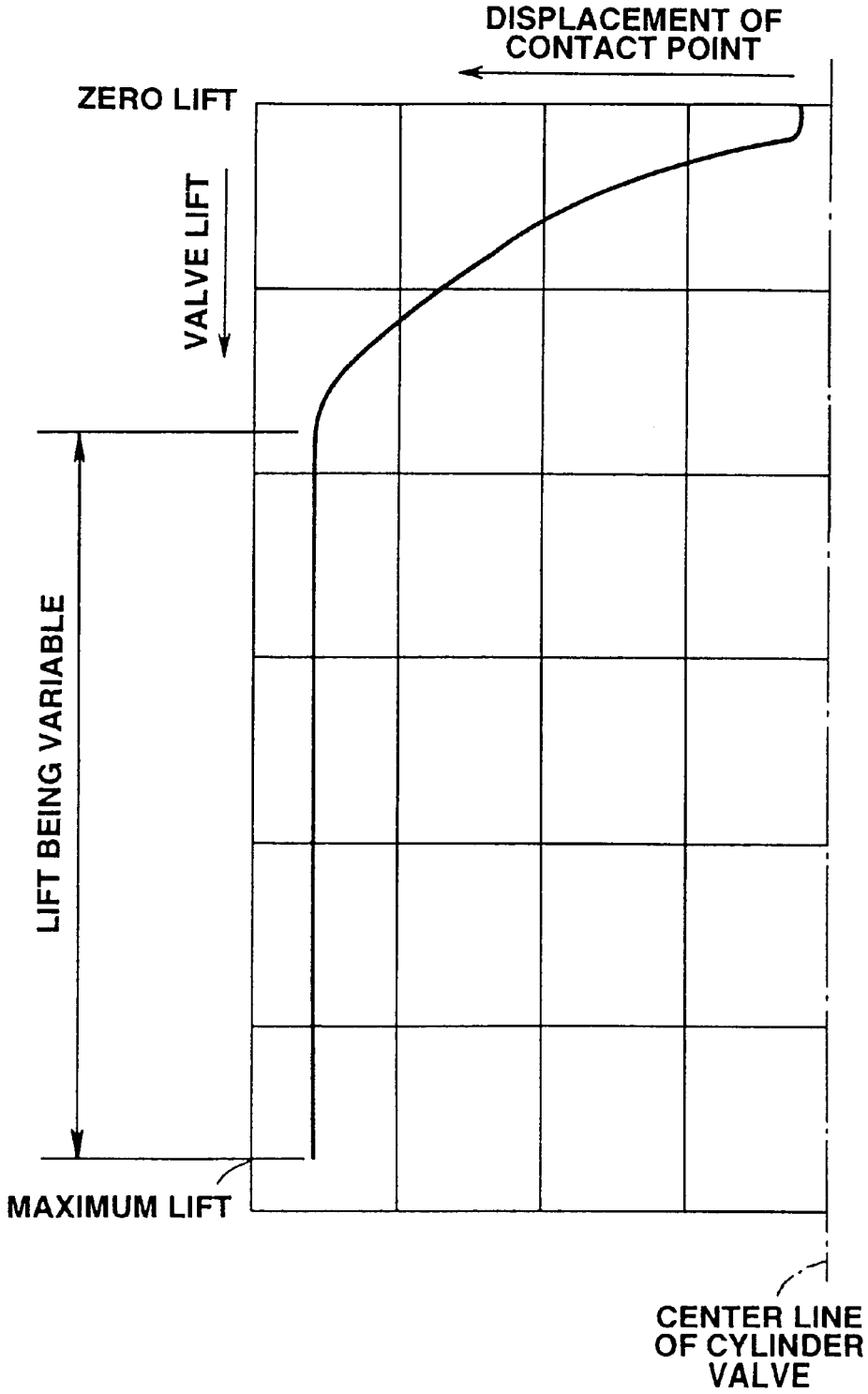
FIG. 21 is a graphical representation of a valve lift versus travel amount characteristic presented by the VVA apparatus of FIG. 18.

Each VO cam 17 has a cam face 22 contoured to provide a valve lift versus travel distance characteristic as shown in FIG. 21. FIG. 21 shows plotting of travel distance versus variation of valve lift from zero lift to maximum lift. The travel distance is the displacement of contact point, at which the cam face 22 contacts with the valve lifter 16, from center line of the intake valve 12. The contact point moves away from the center line of the intake valve 12 toward the edge of upper surface of the valve lifter 16 as the VO cam 17 pivots to push the valve cylinder from zero valve lift to a predetermined valve lift. The contact point stays immobile and spaced a maximum travel distance from the centerline of the cylinder valve 12 during the subsequent further pivotal motion of the VO cam 17 to push the valve lifter from the predetermined valve lift to the maximum valve lift. In other words, the VO cam presses the valve lifter 16 against valve spring at the same contact point to hold the intake valve 12 at a valve lift between the predetermined valve lift and the maximum valve lift. According to the VVA apparatus, valve lifts between the predetermined valve lift and the maximum valve lift as illustrated in FIG. 21 are selected depending upon various engine-operating conditions. This is effective in suppressing cylinder to cylinder variations of valve lift.

The cam face 22 presents the same change in cam lift per unit angular displacement of the VO cam 17 after the contact point has moved by the maximum travel distance. Thus, increasing the change in cam lift per unit angular displacement of the VO cam 17 brings about an increase in valve lift.

If desired, modifying the contour of the cam face 22 will reduce the predetermined valve lift toward zero.

Figure 22:
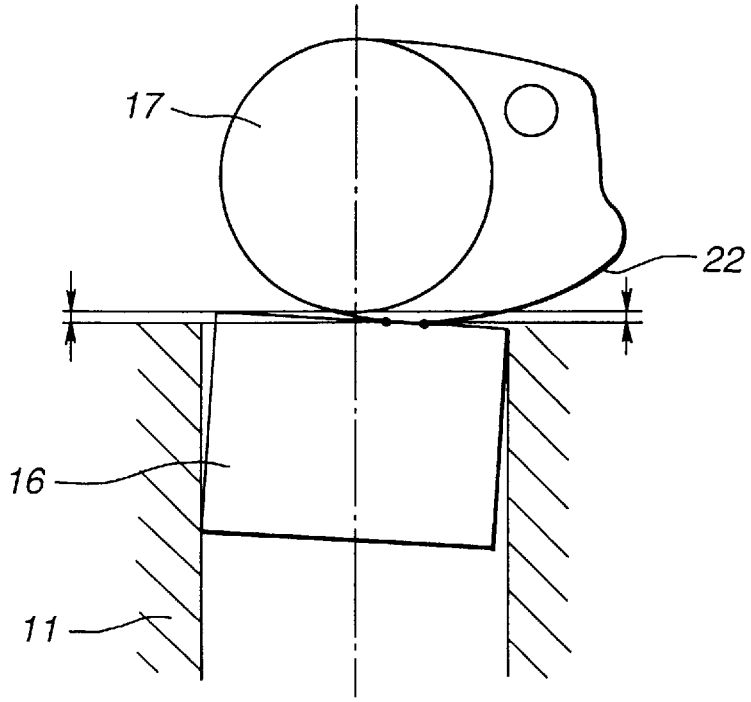
FIGS. 22 to 24 illustrate positions of a VO cam of the VVA apparatus in contact with its associated valve lifter.
Figure 23:
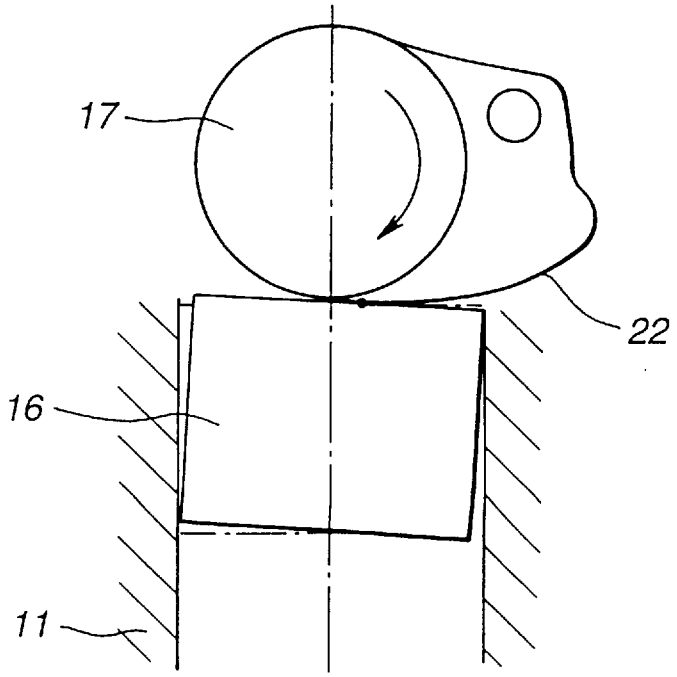

FIG. 22 illustrates a state where a VO cam 17 is in sliding contact with a valve lifter 16. There is a clearance between a guide bore of the engine cylinder head 11 and the valve lifter 16, causing the valve lifter 16 to tilt during its movement to lift the associated cylinder valve 12. Thus, different valve lifts are produced for contact points that are spaced from the centerline of cylinder axis 12 by different travel distances. With regard to tilt of the valve lifter 16, variations in tilt occur due to variations in surface conditions of the cam face 22 and variations in friction between the VO cam 17 and the upper surface of the valve lifter 16 )see FIG. 23). Under this condition, if a maximum lift corresponds to a contact point on the upper surface of the valve lifter 16 within a range of travel of the VO cam 17 to the maximum travel distance point, this contact point moves owing to the variations of tilt. This causes cylinder-to-cylinder variations of valve lift. Furthermore, a valve lift is small over a range from initiation of the travel to the termination thereof at the maximum travel Thus, if the maximum valve lift is set at a point falling within this range due to variations of the valve lift characteristic, a ratio of a variation to the maximum valve lift becomes large, causing considerable cylinder-to-cylinder variations in inflow of combustible charge or outflow of exhaust gas.

Figure 24:
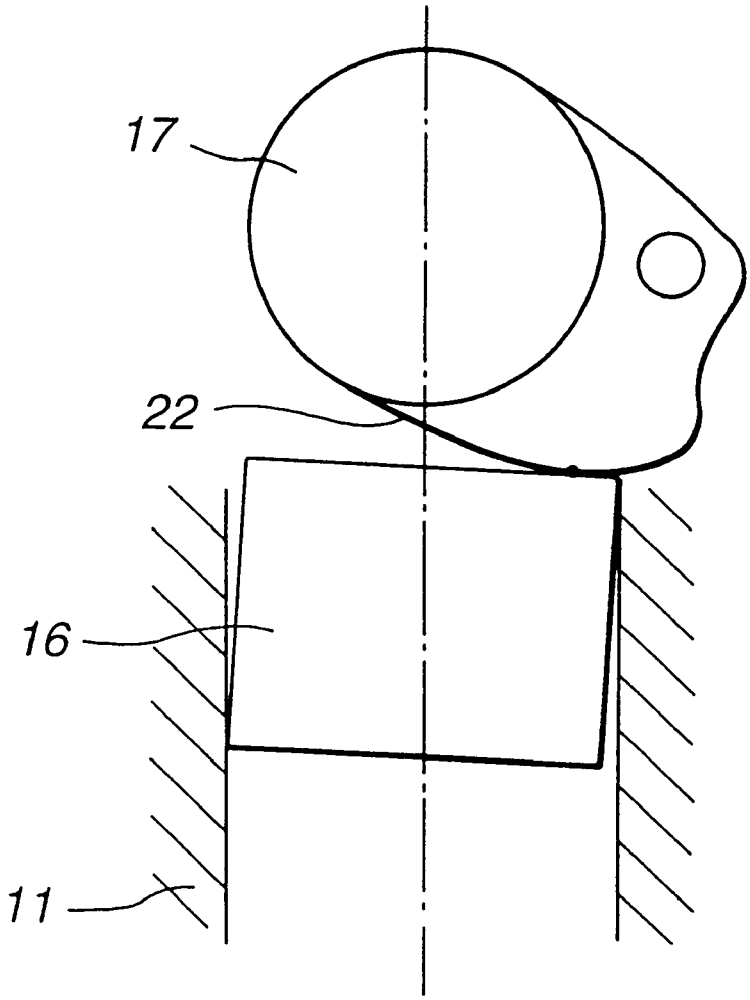

In order to eliminate or minimize cylinder-to-cylinder variation in valve lift, the cam face 22 of each VO cam 17 is so configured as to provide the characteristic as illustrated in FIG. 21, thereby to provide various maximum lifts after completion of travel of the contact point by the maximum travel distance (see FIG. 24). Referring to FIG. 21, the various maximum lifts that are given by various valve lift characteristics provided by the VVA apparatus are set greater than the predetermined valve lift. Thus, particularly during engine operation with relatively small valve lift, cylinder-to-cylinder variation in valve lift is suppressed to a satisfactorily low level.

Figure 25:
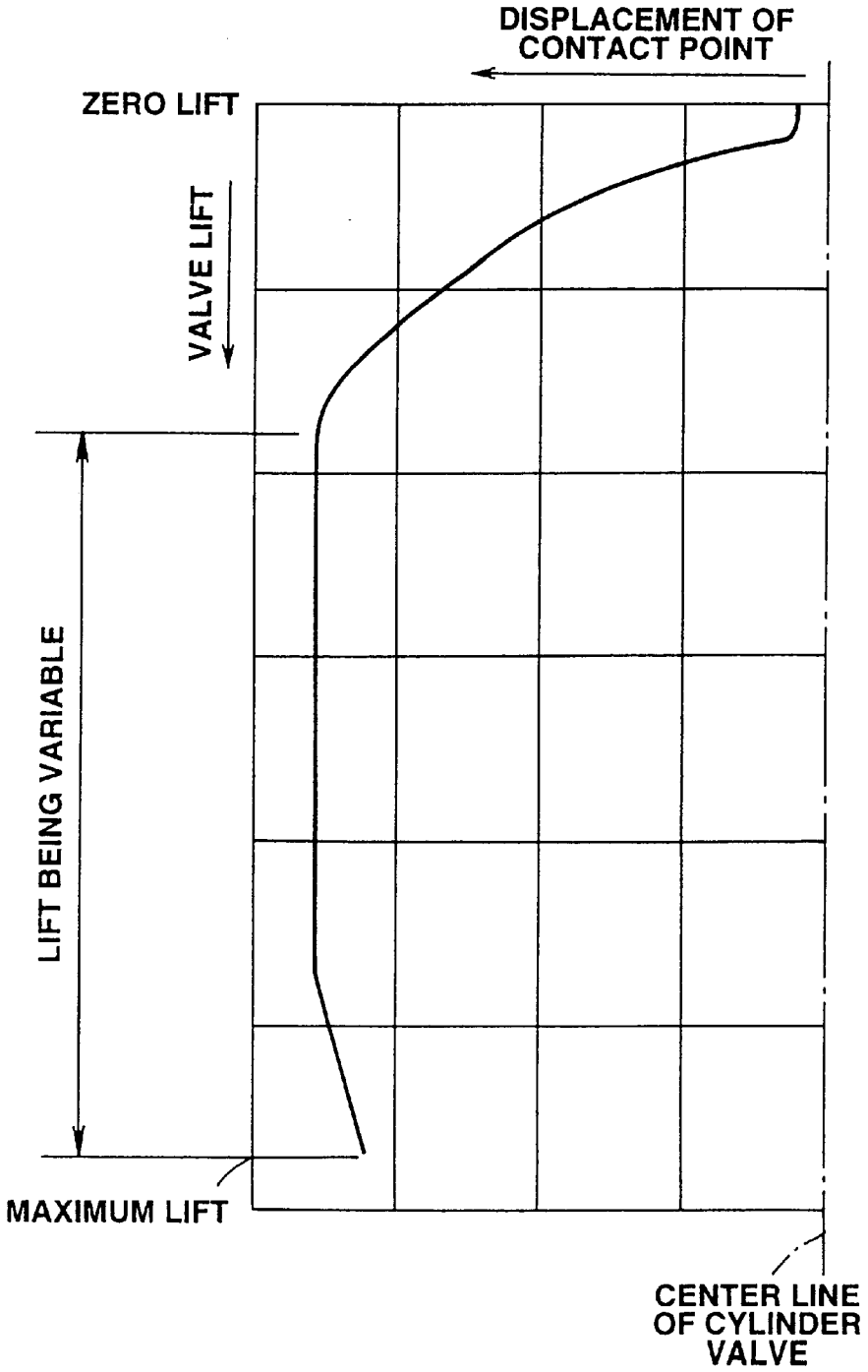
FIG. 25 is a graphical representation of a modified valve lift versus travel amount characteristic.
Figure 26:
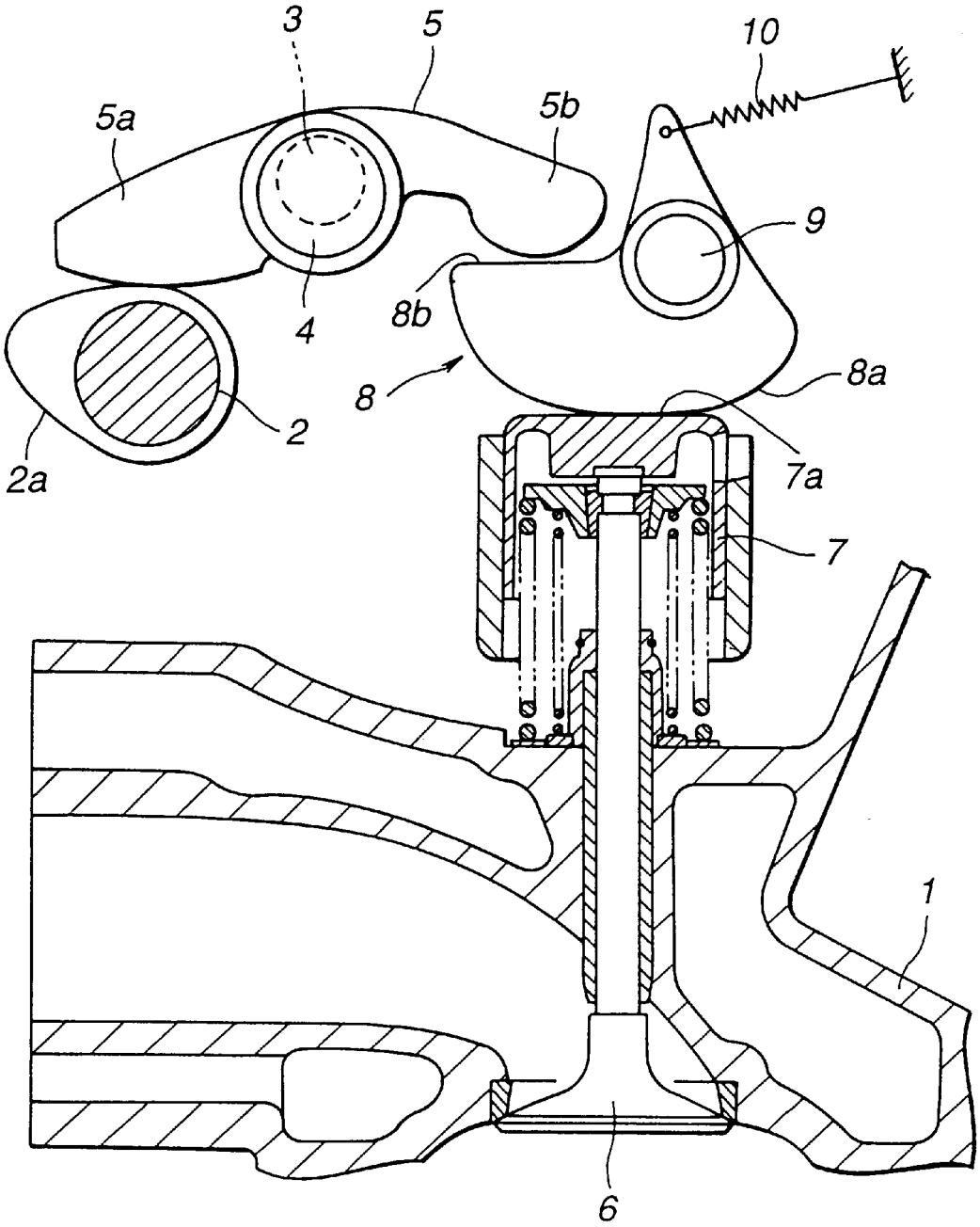
FIG.26 ( PRIOR ART )
FIG. 26 is a view illustrating a prior art VVA apparatus.
Figure 27:
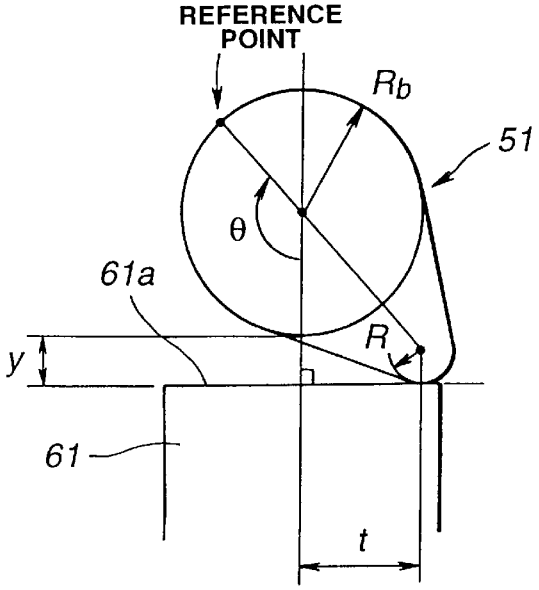
FIG.27 ( PRIOR ART )
FIG. 27 illustrates the relation between a rotary VO cam and a valve lifter.
Figure 28:
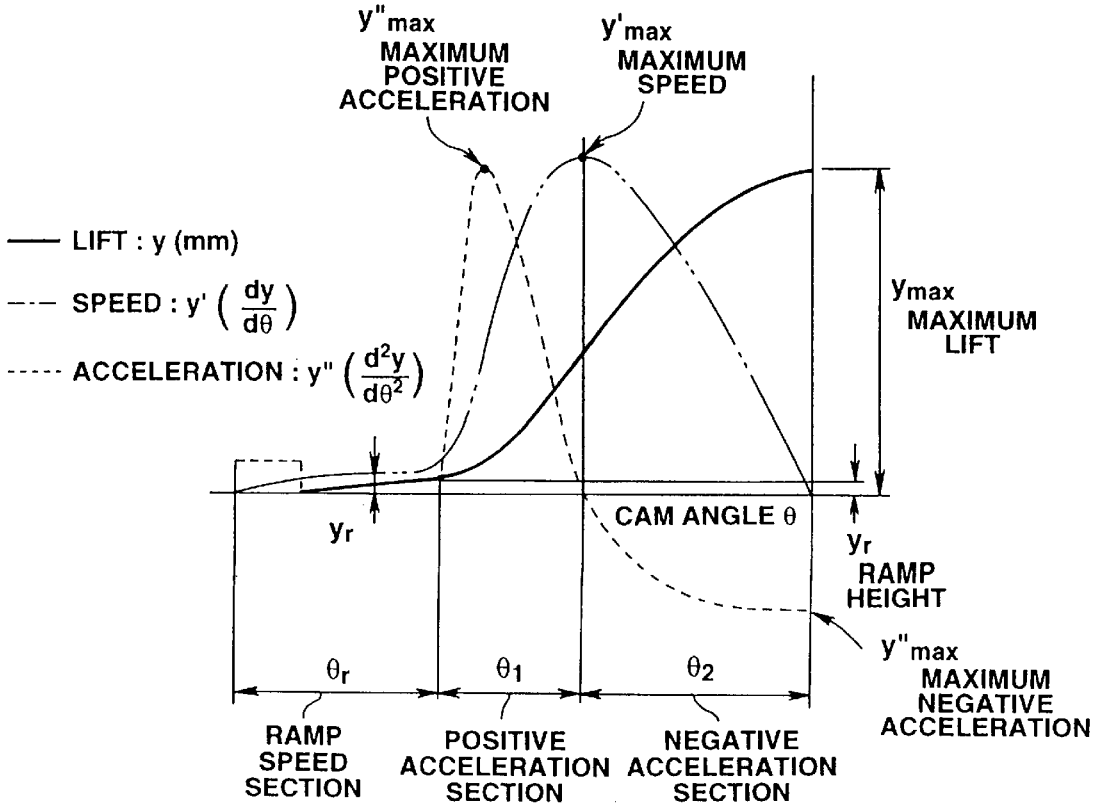
FIG.28 ( PRIOR ART )
FIG. 28 is a graphical representation of characteristics presented by the rotary VO cam.

Referring to FIG. 25, a modified cam face 22 of each VO cam 17 is explained. The characteristic curve illustrated in FIG. 25 is substantially the same as that of FIG. 21 except that the contact point gradually moves away from the maximum travel position toward the centerline of the cylinder valve 12 after a second predetermined valve lift, which is larger than the first mentioned predetermined valve lift, has been exceeded. This first predetermined valve lift is a valve lift when the contact point has moved by the maximum travel distance. It is to be noted that the contact point stays immobile during variation between the first predetermined valve lift and the second predetermined valve lift. Various maximum valve lifts for valve characteristics provided by the VVA apparatus during engine operations except engine operation at high speed with heavy load are set between the first predetermined valve lift and the second predetermined valve lift.

According to the characteristic of FIG. 25, the VO cam 17 can have a gradually varying contour at its maximum lift portion. This contour is advantageous in lifting upper limit of motion of the VO cam 17. In this embodiment, there may occur cylinder-to-cylinder variation in valve lift during engine operation at high speed with heavy load. But, the ratio of variation in valve lift to the maximum valve lift is very small during engine operation at high speed with heavy load. Thus, there is no ill effect on engine performance.

The contents of disclosure of Japanese Patent Application Nos. 10-73642 (filed Mar. 23, 1998) and. 9-358662 (filed Dec. 26, 1997) are hereby incorporated by reference in their entireties.

While the invention has been described in terms of certain embodiments, such are offered as exemplary implementations and shall not be construed as limiting the scope thereof. The embodiments of the invention in which an exclusive property or privilege is claimed are defined as follows:

What is claimed is:

1. A variable valve actuator (VVA) apparatus for an internal combustion engine having an output shaft and a cylinder valve, comprising:

a drive shaft adapted to be driven by the output shaft of the engine for rotation about a drive shaft axis;

a drive cam fixed to said drive shaft for rotation therewith;

a valve operating (VO) cam arranged to pivot about a pivot axis;

a cam follower cooperating with said valve operating cam to move the cylinder valve;

a motion transmitting mechanism converting motion of said drive cam about said drive shaft axis into pivotal motion of said valve operating cam, said valve operating cam having a cam surface that extends at least from a cam lift start point to a maximum cam lift point, said cam surface including a first section providing a ramp section, a second section providing a positive acceleration section, and a third section providing a zero acceleration section that includes a situation where acceleration continuously varies within a predetermined infinitesimal window about zero acceleration, said first section extending from said cam lift start point, said second section connecting continuously and smoothly to said first section and extending therefrom toward said maximum cam lift point, said third section connecting continuously and smoothly to said second section and extending therefrom continuously over a predetermined range.

2. The VVA apparatus as claimed in claim 1, wherein said maximum cam lift point is located within said predetermined range.

3. The VVA apparatus as claimed in claim 1, wherein said cam surface includes a fourth section providing a negative acceleration connecting smoothly and continuously to said third section and extending therefrom over a second predetermined range that is outside a range where the cam surface maintains contact with said cam follower.

4. The VVA apparatus as claimed in claim 1, wherein said third section provides continuously varying acceleration within an infinitesimal range.

5. The VVA apparatus as claimed in claim 1, wherein said third section provides an infinitesimal change in acceleration in negative direction in the neighborhood of the maximum lift position point.

6. The VVA apparatus as claimed in claim 1, wherein said cam follower has a circularly protruded upper surface.

7. The VVA apparatus as claimed in claim 1, further comprising a position controlling mechanism to move position of said motion transmitting mechanism relative to said VO cam, thereby to alter angular position of said VO cam about said pivot axis.

* * * * *